US009956578B2

(12) United States Patent
Seifer

(10) Patent No.: US 9,956,578 B2
(45) Date of Patent: May 1, 2018

(54) PISTON FOR DISPENSING A FLOWABLE COMPONENT FROM A CARTRIDGE

(71) Applicant: Sulzer Mixpac AG, Haag (CH)

(72) Inventor: Ralf Seifer, Sargans (CH)

(73) Assignee: Sulzer Mixpac AG, Haag (CH)

( * ) Notice: Subject to any disclaimer, the term of this patent is extended or adjusted under 35 U.S.C. 154(b) by 0 days. days.

(21) Appl. No.: 15/036,842

(22) PCT Filed: Oct. 8, 2014

(86) PCT No.: PCT/EP2014/071489
§ 371 (c)(1),
(2) Date: May 16, 2016

(87) PCT Pub. No.: WO2015/071029
PCT Pub. Date: May 21, 2015

(65) Prior Publication Data

US 2016/0288159 A1 Oct. 6, 2016

(30) Foreign Application Priority Data

Nov. 18, 2013 (EP) ..... 13193230

(51) Int. Cl.
*B05C 17/005* (2006.01)

(52) U.S. Cl.
CPC .. *B05C 17/00579* (2013.01); *B05C 17/00553* (2013.01); *B65D 2205/04* (2013.01)

(58) Field of Classification Search
CPC ..... B05C 17/00576; B05C 17/00579; B05C 17/00553; B65D 2205/04; B65D 83/0005
USPC ..... 222/190, 326, 327, 386, 387
See application file for complete search history.

(56) References Cited

U.S. PATENT DOCUMENTS 6,494,348 B2 * 12/2002 Prestele ..... B05C 17/00559 222/326
6,598,766 B1 * 7/2003 Brugner ..... B05C 17/00576 222/326
7,748,577 B2 * 7/2010 Brugner ..... B05C 17/00576 222/326
8,678,246 B2 * 3/2014 Reuter ..... B05C 17/00579 220/745

(Continued)

FOREIGN PATENT DOCUMENTS

EP 1908703 A1 4/2008
EP 2468415 A1 6/2012
WO 2011076663 A1 6/2011

*Primary Examiner* — Charles P Cheyney
(74) *Attorney, Agent, or Firm* — Global IP Counselors, LLP

(57) ABSTRACT

A piston for dispensing a flowable component from a cartridge includes a piston having a base body and a venting element. The base body has a passage connecting a component side and an actuation side and has a passage opening. The venting element has an internal connection element and a pin which is partly arranged in the passage opening of the base body. The internal connection element and the pin are connected by a spring element. The pin of the venting element can adopt a sealing position and an aerating position. To enable a secure sealing, the spring element is configured such that it includes an angle of a maximum of 80° with the axial direction in the sealing position of the pin at a connection line to the internal connection element in the direction of an actuation side.

15 Claims, 1 Drawing Sheet

(56) References Cited

U.S. PATENT DOCUMENTS

| | | | | |
|---|---|---|---|---|
| 8,919,616 | B2 * | 12/2014 | Obrist | B05C 17/00576 222/326 |
| 9,144,821 | B2 * | 9/2015 | Obrist | B05B 11/02 |
| 9,469,061 | B2 * | 10/2016 | Frey | B05C 17/00579 |
| 2008/0083789 | A1 | 4/2008 | Brugner | |
| 2011/0146836 | A1 | 6/2011 | Turner | |
| 2013/0277390 | A1 | 10/2013 | Buck et al. | |

* cited by examiner

PISTON FOR DISPENSING A FLOWABLE COMPONENT FROM A CARTRIDGE

CROSS-REFERENCE APPLICATION

This application is a U.S. National Stage Application of International Application No. PCT/EP2014/071489, filed Oct. 8, 2014, which claims priority to European Application No. 13193230.3, filed Nov. 18, 2013, the contents of each of which are hereby incorporated herein by reference.

BACKGROUND

Field of Invention

The invention relates to a piston for dispensing a flowable component from a cartridge.

Background Information

A piston for dispensing a flowable component from a cartridge is described in WO 2011076663 which has a base body and a venting element. The base body has a component side, an actuation side and a passage connecting the component side and the actuation side and having a passage opening. The venting element has an internal connection element by which the venting element can be connected to the base body and a pin which is partly arranged in the passage opening of the base body. The internal connection element and the pin are connected by a spring element which is in turn connected to the internal connection element along a connection line. The pin of the venting element can adopt a sealing position and an aerating position. In the sealing position, the pin is aligned along an axial direction and closes the passage opening in an airtight manner. In the aerating position, the pin is arranged with respect to the base body such that an exchange of air is possible between the component side and the actuation side via the passage. In this respect, the venting element is arranged and configured such that the spring element urges the pin into the sealing position.

To fill the cartridge, the flowable component is typically filled into the cartridge via an inlet disposed opposite the outlet. Subsequently, the piston is inserted into the cartridge and the cartridge is thus closed in the direction of the inlet. Where possible, no air should be located between the component and the piston since otherwise components of the air can react with the component and can thus negatively influence the quality of the component. The pin of the venting element is therefore brought into the aerating position during or at least at the end of the insertion of the piston into the cartridge so that the air between the component and the piston can escape via the passage and the cartridge is thus vented. To set the aerating position, the pin is urged against the restoring force of the spring element in the direction of the component side and thus an exchange of air is made possible through the passage. After the filling, the pin should remain as securely as possible in the sealing position and thus close the component in an airtight manner in the direction of the inlet of the cartridge.

To dispense the flowable component, the piston is displaced in the axial direction in the direction of the outlet of the cartridge. For this purpose, the piston is acted on by an actuation force by a plunger on the actuation side. Depending on the design of the piston and of the plunger, the pin of the venting element is in this respect brought into the aerating position so that it has to be brought back into the sealing position after the end of the action by the actuation force to achieve an airtight closure of the component.

SUMMARY

In view of this, it is in particular the object of the invention to propose a piston for dispensing a flowable component from a cartridge which, on the one hand, allows a venting and, on the other hand, allows a secure airtight closure of the cartridge. In accordance with the invention, this object is satisfied by a piston having the features disclosed herein.

The piston has a base body and a venting element. The base body has a component side, an actuation side and a passage connecting the component side and the actuation side and having a passage opening. The venting element has an internal connection element by which the venting element can be connected to the base body and a pin which is partly arranged in the passage opening of the base body. The internal connection element and the pin are connected by a spring element which is in turn connected to the internal connection element along a connection line. The pin of the venting element can adopt a sealing position and an aerating position. In the sealing position, the pin is aligned along an axial direction and closes the passage opening in an airtight manner. In the aerating position, the pin is arranged such that an exchange of air is possible between the component side and the actuation side via the passage. In this respect, the venting element is arranged and configured such that the spring element urges the pin into the sealing position.

In accordance with the invention, the spring element is configured such that it includes an angle of a maximum of 80° with the axial direction in the sealing position of the pin at the connection line to the internal connection element in the direction of the actuation side. A particularly high preload force thus results, which is exerted by the spring element onto the pin in the axial direction and urges the pin into the sealing position in which the pin contacts a peripheral sealing edge of the passage opening and thus closes the passage opening in an airtight manner. The design of the piston in accordance with the invention in particular provides in an advantageous manner that the pin is also again securely brought into the sealing position after a multiple setting of the aerating position. This is in particular advantageous when, as described above, the aerating position is also set on the dispensing of the component and additionally the component is not dispensed at once, but rather several times after one another in smaller portions, with the piston being displaced in the axial direction in the direction of the outlet of the cartridge on each dispensing.

The named connection line is to be understood as the line on the side of the venting element which is aligned in the direction of the actuation side and at which the internal connection element merges into the spring element. If a so-called bottom radius is formed between the connection element and the spring element, the connection line results at the end of the bottom radius in the direction of the spring element.

The named angle is in particular determined in a section centrally through the pin in parallel with the axial direction. It is then produced between a tangent at a point of the connection line at the contour of the spring element aligned in the direction of the actuation side.

The spring element has a thickness, for example, of 0.3-0.8 mm, in particular of 0.4-0.5 mm.

The flowable component is configured as an adhesive, for example. The pistons in accordance with the invention are also frequently used in so-called two-component cartridges which can receive two different components separately from one another. The two components are mixed with one another on the dispensing, with a chemical reaction taking place which usually results in a hardening of the mixed components. Such two-component cartridges can be used, for example, in the dental area for so-called impression materials or also in the construction sector for so-called chemical dowels. The two individual cartridges of a two-component cartridge can be arranged next to one another or within one another. The piston in accordance with the invention can thus have a cylindrical base shape or an annular base shape. A piston having an annular base shape is also called a ring piston.

The base body and the venting element are in particular configured as two separate components which are combined to form a piston in accordance with the invention before the insertion into a cartridge.

The pin of the venting element in particular has a cylindrical base shape, with its diameter in particular varying in the axial direction so that a conical section of the pin results. The pin in particular tapers in the direction of the actuation side of the piston. The outer contour of the conical section of the pin in particular corresponds with the inner contour of the passage opening so that a sealing surface results in the region between the pin and the passage opening which enables a secure sealing of the passage opening in the sealing position of the pin.

It is particularly advantageous if the spring element includes an angle between 65° and 75°, in particular between 69° and 71° with the axial direction in the sealing position of the pin at the connection line to the internal connection element in the direction of the actuation side.

In an embodiment of the invention, the spring element has a frustoconical contour in the region of the connection line to the connection element. A particular high preload force onto the pin thus results.

In an embodiment of the invention, the internal connection element of the venting element has a predominantly cylindrical base shape and is connected to the base body via an internal latch connection. The internal latch connection in particular has a first and a second recess and corresponding first and second dimples, with the first and second recesses being arranged spaced apart in the axial direction. A particularly stable and secure connection thus results between the venting element and the base body. This makes it possible that the venting element is not displaced with respect to the base body on the urging of the pin into the venting position and thus only the spring element is deflected. The spring element can thus apply an ideal restoring force onto the pin in the direction of the sealing position. It is possible that the connection element has dimples and the base body has recesses. In addition, the converse configuration is possible and also that both components have both dimples and recesses.

In an embodiment of the invention, the piston has, in addition to the internal connection element, an external connection element by which the venting element can additionally be connected to the base body. The internal connection element is in this respect arranged between the external connection element and the pin. This allows a particularly stable and secure connection between the venting element and the base body. The external connection element can in this respect generally be designed in the same way as the internal connection element. It is, however, also possible that the connection element has a dimple which is configured such that it can no longer pass through a further dimple of the base body after the connection to the base body. In this case, the external connection element latches into the base body on the connection to the base body.

In an embodiment of the invention, the base body and the venting element are manufactured by an injection molding process, in particular from different materials. The piston can thus be manufactured inexpensively, on the one hand, and the material can be exactly matched to the demands. The base body can, for example, comprise polyethylene, polypropylene or polyamide and the venting element can comprise polyamide or polypropylene with an admixture of glass fiber, for example.

BRIEF DESCRIPTION OF THE DRAWINGS

The invention will be explained in more detail hereinafter with reference to the drawings.

DETAILED DESCRIPTION OF THE EMBODIMENTS

Figure 1:
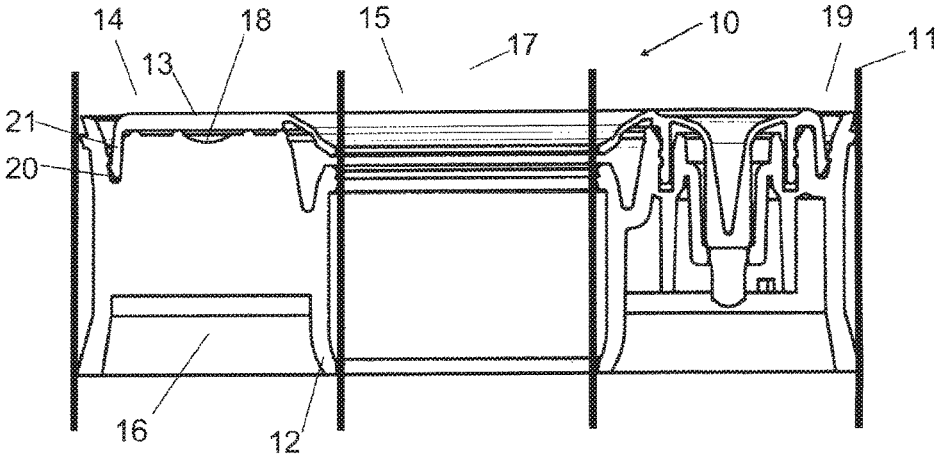
FIG. 1 is a sectional representation of a piston in a cartridge which is only indicated.

In accordance with FIG. 1, a piston 10 for dispensing a flowable component from a cartridge 11, only indicated, has a base body 12 and a venting element 13. The cartridge 11 has an annular cross-section at least in the region in which the piston 10 is arranged. An external storage space 14 thus results for a first component, not shown, and an internal storage space 15 for a second component, likewise not shown, which is arranged within the external storage space 14. The piston 10 is configured as a so-called ring piston and is thus arranged in the external storage space 14. An inner piston, not shown, is configured to dispense the second component in the internal storage space 15. The cartridge 11 has a volume of 50-1500 ml, for example.

The base body 12 has an actuation side 16 via which it and thus the piston 10 can be acted on with an actuation force by a plunger, not shown, and can thus be displaced within the cartridge 11 in the direction of an axial direction 17 in the direction of an outlet, not shown, of the cartridge 11. The first component located in the external volume space 14 can thus be dispensed. The base body 12 additionally has a component side 18 at the side disposed opposite the actuation side 18 and the venting element 13 is arranged at the component side. The venting element 13 is designed such that it covers the complete component side 18 of the base body 12 with the exception of a peripheral marginal region 19.

The base body 12 has at its external marginal region a peripheral groove 20 in which a predominantly hollow cylindrical external connection element 21 of the venting element 13 dips. The groove 20 and the connection element 21 have corresponding projections, not shown in any more detail, which are configured such that the external connection element 21 latches into the groove 20.

In a region of the piston 10, the base body 12 has a cup-shaped passage 22 at which base a predominantly cylindrical passage opening 23 is arranged. The passage 22 connects the actuation side 16 and the component side 18 of the base body 12 of the piston 10. The section through the piston 10 shown in FIG. 1 extends centrally through the passage 22. The region of the piston 10 with the passage 22 is shown in enlarged form in FIG. 2.

The venting element 13 has a pin 24 which is arranged partly in the passage 22 of the base body 12 and which projects through the passage opening 23. The pin 24 is connected to a predominantly hollow cylindrical internal connection element 26 via a spring element 25, with a circular connection line 27 resulting on the transition from the spring element 25 to the connection element 26. The spring element 25 has a thickness of approximately 0.5 mm. The internal connection element 26 dips into a corresponding recess 28 of the base body 12. The internal connection element 26 has two dimples 29, 30 which are arranged offset with one another in the axial direction 17. The recess 28 of the base body 12 has two corresponding recesses 31, 32 into which the two dimples 29, 30 latch in the shown assembled state of the piston 10 and thus ensure a secure fixing of the connection element 26 and thus of the total venting element 13 with respect to the base body 12. The dimples 29, 30 and the corresponding recesses 31, 32 thus form an inner latch connection between the internal connection element 26 and the base body 12.

Figure 2:
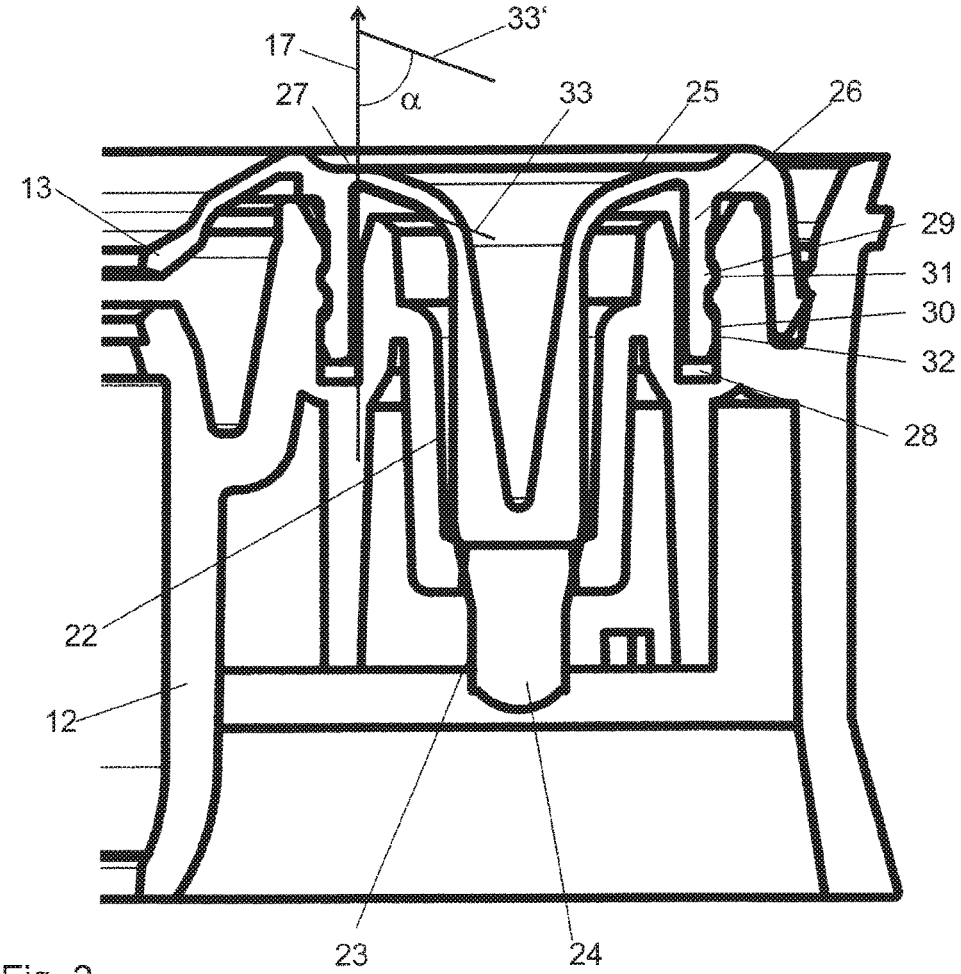
FIG. 2 is a detail of the piston of FIG. 1 in an enlarged representation.

In a sealing position shown in FIGS. 1 and 2, the pin 24 closes the passage opening 23 of the base body 12 in an airtight manner so that no exchange of air can take place between the actuation side 16 and the component side 18. To achieve a secure sealing, the pin 24 has a slightly conical extent in a region so that it tapers slightly in the direction of the actuation side 16. The passage opening 23 has a corresponding contour so that a large sealing surface results. The pin 24 is aligned along the axial direction 17 in the sealing position. The pin 24 can be brought out of the sealing position shown into an aerating position, not shown, by displacing the pin 24 against a preload force of the spring element 25 in the direction of the component side 18 by a plunger, not shown. In the aerating position, the pin 24 is arranged with respect to the passage opening 23 such that an annular aerating gap results between the pin 24 and the passage opening 23 via which aerating gap an exchange of air is possible between the component side 18 and the actuation side 16.

The spring element 25 has a frustoconical contour in the region of the connection line 27 to the connection element 26. The spring element 25 is configured and arranged such that it includes an angle $\alpha$ of approximately 70° with the axial direction 17 in the sealing position of the pin 24 at the connection line 27 to the internal connection element 26 in the direction of the actuation side 16. The connection line 27 is to be understood as the line on the side of the venting element 13 which is aligned in the direction of the actuation side 16 and at which the internal connection element 26 merges into the spring element 25. The angle $\alpha$ then results in FIG. 2 between a tangent 33 at a point of the connection line 27 at the contour of the spring element 25 aligned in the direction of the actuation side 16 and the axial direction 17. For better clarity, the tangent is additionally shown displaced in the direction of the component side 18 (reference numeral 33').

The base body 12 and the venting element 13 are each manufactured by an injection molding process. The base body 12 in this respect comprises polyethylene and the venting element 13 comprises polyamide.

The invention claimed is:

1. A piston for dispensing a flowable component from a cartridge, the piston comprising a base body; and a venting element, the base body having a component side, an actuation side and a passage connecting the component side and the actuation side and having a passage opening;

the venting element having an internal connection element by which the venting element is connected to the base body, a pin arranged at least partly in the passage of the base body, and a spring element connecting the internal connection element and the pin, and which is connected to the internal connection element along a connection line, the pin of the venting element configured to adopt a sealing position in which the pin is aligned along an axial direction and the passage opening is closed in an airtight manner, and an aerating position in which an exchange of air is capable between the component side and the actuation side via the passage, the venting element being arranged and configured such that the spring element is configured to urge the pin into the sealing position, and the spring element being configured to include an angle between 65° and 75° with the axial direction in the sealing position of the pin at the connection line to the internal connection element in the direction of the actuation side.

2. The piston in accordance with claim 1, wherein the angle is between 69° and 71°.

3. The piston in accordance with claim 1, wherein the spring element has a frustoconical contour in a region of the connection line to the internal connection element.

4. The piston in accordance with claim 1, wherein the internal connection element has a predominantly cylindrical base shape and is connected to the base body via an internal latch connection.

5. The piston in accordance with claim 4, wherein the internal latch connection has a first recess and a second recess and corresponding first and second dimples, with the first and second recesses being arranged spaced apart in the axial direction.

6. The piston in accordance with claim 1, further comprising an external connection element by which the venting element is connected to the base body, with the internal connection element being arranged between the external connection element and the pin.

7. The piston in accordance with claim 1, wherein the base body and the venting element are manufactured by an injection molding process.

8. The piston in accordance with claim 7, wherein the base body and the venting element comprise different materials.

9. The piston in accordance with claim 2, wherein the spring element has a frustoconical contour in a region of the connection line to the internal connection element.

10. The piston in accordance with claim 2, wherein the internal connection element has a predominantly cylindrical base shape and is connected to the base body via an internal latch connection.

11. The piston in accordance with claim 3, wherein the internal connection element has a predominantly cylindrical base shape and is connected to the base body via an internal latch connection.

12. The piston in accordance with claim 2, further comprising an external connection element by which the venting element is connected to the base body, with the internal connection element being arranged between the external connection element and the pin.

13. The piston in accordance with claim 3, further comprising an external connection element by which the venting element is connected to the base body, with the internal connection element being arranged between the external connection element and the pin.

14. The piston in accordance with claim 4, further comprising an external connection element by which the venting element is connected to the base body, with the internal connection element being arranged between the external connection element and the pin.

15. The piston in accordance with claim 5, further comprising an external connection element by which the venting element is connected to the base body, with the internal connection element being arranged between the external connection element and the pin.

* * * * *